United States Patent [19]

Zink et al.

[11] 3,933,420

[45] Jan. 20, 1976

[54] VERTICALLY FIRED BURNER FOR WASTE COMBUSTIBLE GASES

[75] Inventors: John S. Zink; Robert E. Schwartz; Robert D. Reed, all of Tulsa, Okla.

[73] Assignee: John Zink Company, Tulsa, Okla.

[22] Filed: Aug. 19, 1974

[21] Appl. No.: 498,276

[52] U.S. Cl. ..... 431/202; 23/277 C

[51] Int. Cl. ..... F23d 13/20

[58] Field of Search ..... 431/202, 5, 159, 187, 190; 23/277 C

[56] References Cited

UNITED STATES PATENTS

| | | | |
|---|---|---|---|
| 2,879,862 | 3/1959 | Burden | 23/277 C |
| 3,009,513 | 11/1961 | Houdry | 431/5 |
| 3,754,869 | 8/1973 | Raden | 23/277 C |
| 3,779,689 | 12/1973 | Reed et al. | 431/202 X |

*Primary Examiner*—Edward G. Favors

[57] ABSTRACT

A vertically fired means for the combustion of waste gases in a noise-proof manner having a vertically oriented cylindrical furnace with burner insertion into the bottom of the furnace, which is raised a selected distance above the surface grade. The inlet air opening at the bottom of the furnace is of a cross section area less than a selected fraction of the cross section area of the combustion zone. A cylindrical windshield encircling the bottom of the furnace provides limited access of air to the area below the inlet air opening at the bottom of the furnace to suitably isolate wind flow from the inlet air opening. The cross-sectional area for air flow due to limited access is at least equal to a selected fractional area of the furnace, which is the inlet air opening. Suitable isolation of air flow energies from the inlet air opening requires the limited access area to be no greater than 2.5 times the air inlet area. The inlet air opening is preferably not more than 85% of the furnace area. One or more burners are provided from suitable manifolds so that the flame resulting from the combustion of the waste gases issues preferably in the inlet air opening to the furnace. The inlet air opening area is preferably in the range of 0.2 to 0.85 of the cross section area of the furnace.

9 Claims, 3 Drawing Figures

VERTICALLY FIRED BURNER FOR WASTE COMBUSTIBLE GASES

BACKGROUND OF THE INVENTION

This invention lies in the field of combustion apparatus. More particularly, it is concerned with a vertically fired furnace for the combustion of waste combustible gases in a noise-proof and glare-proof manner, to satisfy environmental requirements.

It is further in the field of combustion devices which are out in the open and exposed to current wind flow. Provision must be made for protection from the wind effects so that the combustion is not seriously effected by the pressures and vacuums caused by the flow of the wind over the furnace.

In the conventional vertically oriented furnaces with burner insertion in the side of the furnace wind baffles must be provided to prevent wind force from directly reaching the burners. Such wind baffles do divert the direct wind force from burners but have a disadvantage that can be serious according to the volume of gas being burned. The disadvantages exists because wind impact increases pressure at the upwind surface of the wind baffle in an amount equal to V2/2g energy of the wind, but at the downwind surface pressure is decreased by essentially the same amount.

The upwind pressure increase plus the low downwind pressure causes violent air flow inside the baffle means, which may upset the pressure to the various burners which receive air for combustion from the space inside of the wind baffle. At low gas burning rates, this effect has caused flame to be drawn back out of the burners into the space inside of the wind baffle, where there can be considerable heat damage to the structure. It becomes important, therefore, to so design the wind baffle that a uniform air pressure which is substantially equal to atmospheric pressure is available at the air inlet, so as to supply air uniformly to the combustion flame.

SUMMARY OF THE INVENTION

It is a primary object of this invention to provide a furnace construction with a suitable wind baffle means to provide a uniform pressure condition at the inlet to the furnace, within the shielding of the wind baffle.

This and other objects are realized and the limitations of the prior art are overcome in this invention by using a vertically oriented cylindrical furnace of cross sectional area A. The cross sectional shape can be circular or polygonal. The height of the furnace should be at least equal to the diameter of the furnace, and preferably greater. The furnace wall can be made of sheet metal and is preferably lined with refractory so as to protect the metal. The lower end of the furnace is partially closed with an annular disc. The inner diameter of the disc is such that with the burners in place within the opening of this annular plate, the area of cross section for the movement of air into the combustion zone inside the furnace is B, where B is in the range of 0.2 to 0.85 of area A.

The furnace is supported on columns so that the base of the furnace is a selected distance above the grade surface. To protect the lower end of the furnace from direct wind contact, a cylindrical wall, baffle or wind shield is provided, substantially coaxial with the furnace and in one embodiment, of larger diameter, such that the cross sectional area of the annular space between the baffle and the outer surface of the furnace is at least equal to 0.9A, but no greater than 2A. The baffle is preferably of a height somewhat greater than the distance of the base of the furnace above the grade surface.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
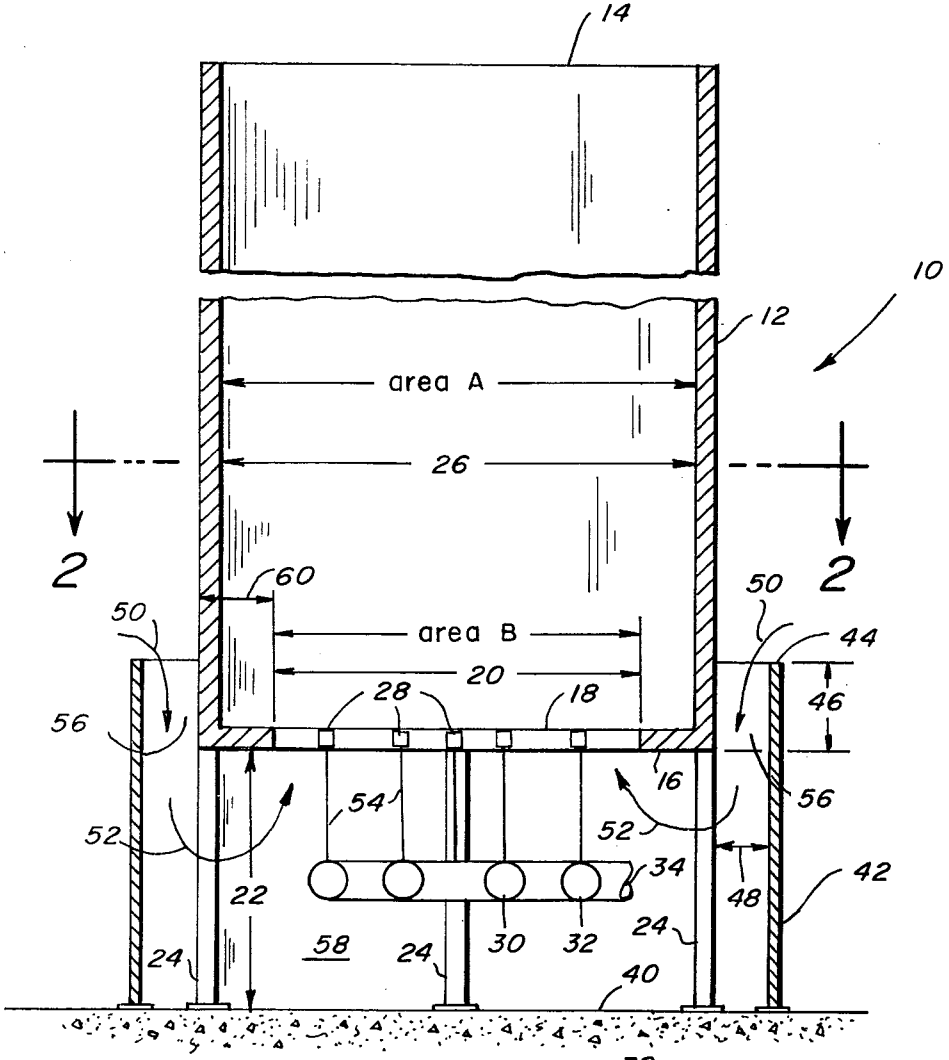
FIG. 1 represents a vertical cross sectional view of the furnace and the wind baffle.

Referring now to FIG. 1, the furnace is indicated generally by the numeral 10. It comprises a cylindrical structure 12 with vertical axis, the internal diameter is represented by the numeral 26 and there is a cross sectional area indicated by the letter A. At the lower end of the cylindrical furnace structure there is a partial closure in the form of an annular plate 16 which has a central axial opening 18 of diameter indicated by numeral 20, the area of the opening exclusive of the obstruction provided by the burners 28 is indicated by the letter B. There is a preferred range to the ratio of area B to area A.

The furnace 12 is of a selected height which is greater than the diameter indicated by the numeral 26. Furthermore, it is raised a selected distance 22 above the grade surface 40 and supported on a plurality of legs 24, in a manner well known in the art. There is a manifold, or plural manifolds, indicated by the numerals 30 and 32 having conduit inlets 34 and 36, respectively, for supplying the waste combustible gas to the burners, indicated schematically by the numerals 28. These are supplied with the combustible waste gas by means of risers 54 so that the burners 28 are substantially in the plane of the disc 16. Thus, there is good turbulent contact between the inlet air going upward through the opening 18 in accordance with arrows 52 and the combustible gas issuing from the burners.

A cylindrical wind screen, or shield, 42 is provided surrounding the furnace, and having a closed contact at its bottom end with the grade surface 40. The height of the wind screen 42 is such that the upper end 44 is well above the bottom 16 of the furnace by a length such as 46 for example. Combustion air enters the furnace through the annular area 56 between the outside of the furnace wall and the inside of the wind screen, down into the space 58 below the furnace and up through the opening 18. Here the air mixes with the gas issuing from the burners 28 and forms a turbulent mixture which is ignited and maintained in an ignited state by means of one or more pilot lights, not shown, but well known in the art. This turbulent mixing of the inlet air with the combustion gas provides for rapid and complete burning, so that by the time the hot gas has reached the top 14 of the furnace, there is complete combustion with a minimum of pollutants that would effect the environment in the vicinity of the furnace.

The combustion is preferably complete within the cylindrical wall of the furnace, so that there is no glare or light evolved from the gases emerging from the top of the furnace.

Air movement from the space 58 below the floor of the furnace is primarily due to the draft inside of the furnace due to the presence of the heated gas inside the furnace, compared to the cool atmospheric air outside of the furnace. The inlet air rising upwardly in the space 58 meets the gases discharged from the burners within the opening 18 at the base of the furnace so that the burning which results can proceed within the interior of the furnace. However, when small quantities of gas are being burned there is little heat inside the furnace to create draft or "stack" effect. As a result there is very little draft, which typically would be in the order of 0.03 inch WC.

If the base of the furnace is not protected by a windshield, then wind blowing under the furnace will generate a suction at the opening 18, which even with low wind velocities would tend to reverse the flow of gases in the furnace and to draw the flame from inside the furnace down into the space 58, where the flame could do damage to the metal parts of the burners and structure.

If with the furnace draft 0.03 inch WC there should be unobstructed flow of wind at 10 miles per hour (14.66 feet per second) in the space between the furnace and the grade surface, the low pressure exerted by the moving wind would be −0.049 inch WC and the burning gas would be drawn downwardly into the space between the opening 18 and outside of the furnace. At 20 miles per hour (29.33 feet per second) the wind exerted low pressure is −0.198 inch WC which is greater than the draft effect created by burning of significantly increased gas quantity, and the flame would move downwardly into the space beneath the furnace to create greater heat damage. This explains why it is vital to the operation of vertically fired furnaces to completely isolate the area adjacent the upstream entrance to a burner opening from any significant cross air movement.

Air must be admitted to the space beneath the bottom of the furnace to permit burning of gas as discharged from the burners in a satisfactory manner. That is, air movement from the space beneath the floor must be toward the interior of the furnace in any case. It is also vitally important to a satisfactory state of burning for the air movement to be at greatest possible velocity.

The velocity of air movement through a burner opening is proportional to the square root of the pressure drop. Since the draft energy occurs inside the furnace toward which the air movement is required, and since the pressure drop is the pressure difference between the space beneath the furnace and the interior of the furnace, it is obvious that any low pressure due to wind caused air velocity in the space beneath the furance is to be avoided.

In this invention air enters the space beneath the furnace through the annular area 56 in accordance with the flow arrows 50. The air entry direction is downwardly and at a point most removed from burner opening 18. Entry velocity is spent in the downward direction to establish a stable pressure condition for upward air movement to the area adjacent to the upstream entry to the burner opening 18 in which one or more burners 28 are disposed. Any number of burners, of course, can be used, as desired, in accordance with the volume of combustible gas to be burned. The design of the burners and their spacing, etc. form no part of this invention and conventional designs of burners and manifolds are satisfactory. The important thing is that the burners are positioned within the opening 18 so that the air and gas meet at a point where the velocity of the air is the greatest, that is, within the reduced area B of the entrance opening, as compared to the larger area of the space below the burner, and the larger space above the burners, inside the furnace.

For optimum conditions the area B of the air opening 18, that is, the free air space between the burners within the opening 18, which is defined as area B, should be not more than 0.85 of the area A of the furnace. The ratio of B/A as small as 0.2 provides the minimum area B that should be provided. A preferred value would be in the range of 0.5 to 0.75 of the area A.

One reason for making the area B smaller than A is to obtain higher velocity of air movement in the region of the issuance of gas from the burners, to get maximum turbulence. Another reason is to provide a radial distance 60 of the opening 18 in the bottom annular plate 16, so that the location of the burning gas in the opening 18 is displaced as much as possible from the annular space 56 where there is a movement of inlet air.

This specification is made for several reasons. One reason is to be sure that the dimension 60 sufficiently isolates the outer edge of the inlet air opening 18 from the velocity of air entry into the space 56. Another reason is that since air flows through burner opening 18 at a velocity according to the square root of the differences in pressure beneath the furnace and the pressure inside the furnace, pressure difference is required for suitable operation when gas flow for burning is either minor or major.

If the area B should be equal to the area A the recited pressure difference would be very small, for example, 0.10 inch WC, but if the area B should be 0.85 of the area A the pressure difference would rise from 0.10 inch WC to 0.138 inch WC. The rise in pressure drop would increase air flow velocity 17.6 percent to better burn the gas. But this velocity increase is the least that can be accepted. If the area B should be 50 percent of the area A the velocity increase would be 100 percent. An earlier statement is that maximum air flow velocity is critical in satisfactory burning. It is critical because air flow velocity is a source of turbulence. Burning completeness and speed is directly proportional to turbulence and turbulence is proportional to air velocity.

The area of annular space 56 is, as has been stated, at least equal to the area B. The area 56 is established by the spacing of the wind baffle from the exterior of the furnace. The downward flow or air in accordance to arrows 50 is critical for even pressure in the space below the furnace, cannot be maintained if the area 56 is more than 2.5 times the area B. In other words, the area 56 should be at least equal to but not more than 2.5 times the area of B.

Note that also the area B is the total cross section area which may be provided by one or more burner openings. But for all cases, the dimension 60 holds for burner opening area closest to the air flow, as per the arrows 50. As a rule of thumb, dimension 60 is dimension 26 times 0.04 plus refractory thickness for the furnace wall above 16 as a minimum figure.

While the furnace is described as cylindrical with vertical axis, the cross section can be circular or any desired polygonal shape. Similarly, the wind shield or baffle can correspondingly be circular or polygonal.

Figure 2:
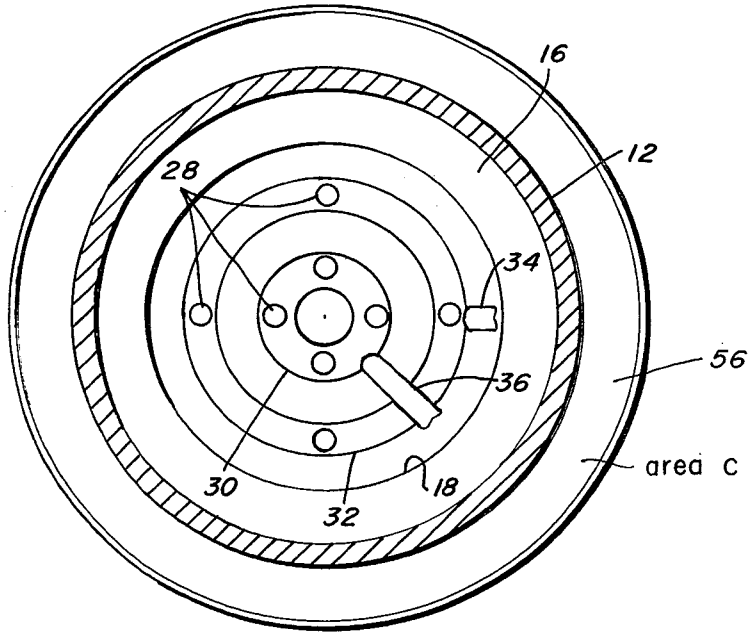
FIG. 2 is a cross sectional view of the system of FIG. 1 taken along the plane 2—2.
Figure 3:
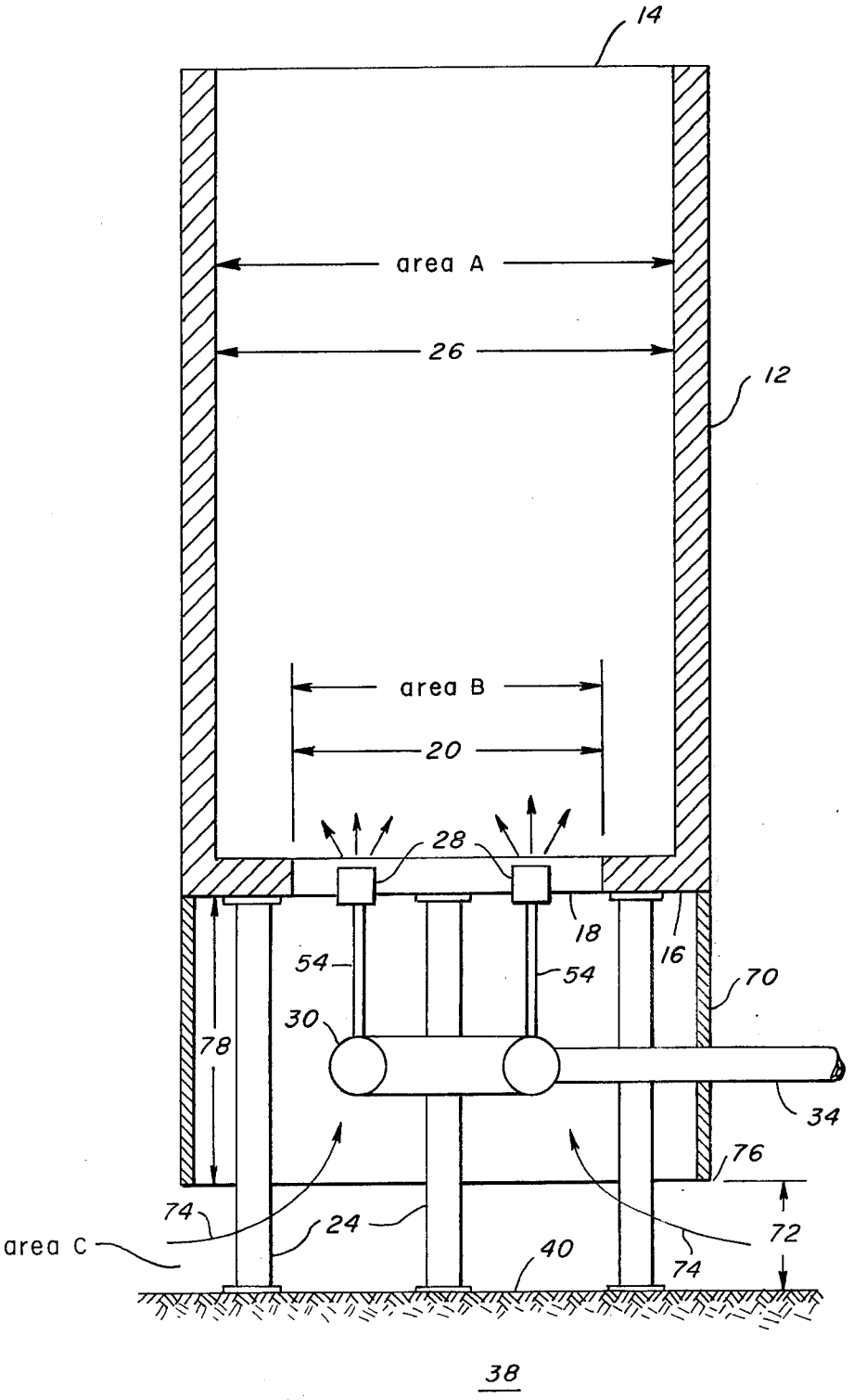
FIG. 3 represents a second embodiment of wind baffle.

Referring now to FIG. 3 there is shown a variation of the embodiment of FIGS. 1 and 2. The difference lies substantially in the positioning of the wind shield or screen. In FIG. 1 the wind shield is a cylindrical metal element which is of larger diameter and substantially coaxial with the furnace cylinder 12. The wind screen 42 has an annular radius 48 greater than that of the cylinder, and while its bottom edge rests on the grade, its top edge 44 is a selected distance 46 above the bottom of the cylinder 16.

In FIG. 3 the wind screen comprises a skirt 70 which is attached to and is substantially a continuation downward of the outer surface of the cylinder 12. The skirt 70 terminates with its lower edge 76 a distance 72 above the grade surface 40. Air for combustion enters the cylinder 12 through the circumferential area C below the skirt, in accordance with arrows 74, and passes upward through the opening 18, past the burners where it mingles with the issuing gas from the burners 28.

The length of skirt 78 below the base 16 of the cylinder, in combination with the length of the support columns 24, is such that the turbulence of the wind driven air below the skirt is sufficiently far displaced from the opening 18 in the base of the cylinder that there is little, if any, effect on the air through the opening 18, due to the turbulence in the opening C. All other factors in FIG. 3 which are substantially the same as those in FIG. 1 including the ratio of areas A and B, and the positioning of the burners within the opening 18 so as to meet the incoming air at its maximum velocity, etc.

With the skirt type of windscreen of FIG. 3, it will be obvious that the dimension 60 shown in FIG. 1 will be of little importance. Conversely, the dimension 78 of FIG. 3 will be of the same importance to FIG. 3 that the dimension 60 is to FIG. 1. The dimension 48 of FIG. 1 compares to the dimension 72 of FIG. 3.

The ratio of the areas B and A are substantially the same in both FIGS. 1 and 3 and the area of opening C of FIG. 3 and area 56 of FIG. 3 and area 56 of FIG. 1 are in the same ratio to their corresponding areas B.

As in FIG. 1, the wind screen of FIG. 3 is for the purpose of controlling the air inlet to the burners in such a way that there will always be a substantially atmospheric pressure below the burners compared to the draft-reduced pressure above the burners, in spite of wind action, and further, whatever wind action there is, and the turbulence that it forms, will be substantially distant from the burners, so that such turbulence will not affect the distribution of air to the burners.

While the skirt 70 is shown to have the same diameter as the outer surface of the cylinder 12, the diameter of the skirt can be of other diameter so long as it is sealed to the annular flange 16. Also, the cross-sectional shape of the skirt 70 can, corresponding to the shape of the cylinder 12, be circular or polygonal.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A vertically fired furnace for burning combustible waste gases comprising;

a. a cylindrical or polygonal furnace of internal cross-sectional area A, said furnace supported with its axis vertical and with its base a selected distance above the grade surface on which it is supported;

b. plate means partially closing off the bottom of said furnace, said plate means having at least one opening for air and fuel entry;

c. burner means positioned in said at least one opening, in the plane of said plate means, the net cross-sectional area of said at least one opening for the passage of air being B;

d. cylindrical wind baffle means coaxial with the bottom of said furnace, and partially enclosing the space between the bottom of said furnace and the grade surface on which said furnace is supported, the remaining opening for supplying combustion air to said burner means being of area C and positioned at least a selected distance from said burner means; and e. means to supply combustible gas to said burner means.

2. The furnace as in claim 1 in which said wind baffle comprises a cylindrical or polygonal metal wall of diameter greater than the diameter of said furnace, said wall resting on said grade surface and extending above the bottom of said furnace, providing an annular air opening of area C.

3. The furnace as in claim 1 in which said wind baffle comprises a cylindrical metal skirt depending from and coaxial with the bottom of said furnace, and extending downward and spaced from said grade surface, leaving a circumferential opening of area C.

4. The furnace as in claim 1 in which area B is not more than 0.85 area A.

5. The furnace as in claim 1 in which area B is in the range of 0.2 to 0.85 times area A.

6. The furnace as in claim 1 in which area B is in the range of 0.5 to 0.75 times area A.

7. The furnace as in claim 1 in which said area C is in the range of 1.0 to 2.5 times area B.

8. The furnace as in claim 1 including refractory lining on the interior surface of said furnace wall and said plate means.

9. The furnace as in claim 1 in which the minimum dimension from the outside surface of said furnace to the nearest edge of said area B is equal to $(0.04\ D + T)$ where D is the internal-diameter of the furnace and T is the thickness of refractory coating inside the said furnace above area B.

* * * * *